United States Patent [19]

Roesler

[11] 3,995,925

[45] Dec. 7, 1976

[54] COMBINED PRODUCT DISPLAY AND STORAGE UNIT

[76] Inventor: Guenter R. Roesler, 18 First Road, Marlboro, Mass. 01752

[22] Filed: Sept. 16, 1974

[21] Appl. No.: 506,096

[52] U.S. Cl. ..... 312/234; 211/55; 312/118; 312/250; 312/283

[51] Int. Cl.[2] ..... A47B 67/02; A47B 97/00

[58] Field of Search ..... 211/36, 55, 148, 150, 211/153, 177; 312/117, 118, 183, 234, 234.5, 278, 250, 283

[56] References Cited

UNITED STATES PATENTS

| | | | |
|---|---|---|---|
| 1,401,356 | 12/1921 | Parchert | 211/36 |
| 2,285,491 | 6/1942 | Clark | 211/36 |
| 3,810,430 | 5/1974 | Siegal | 211/148 |

*Primary Examiner*—Casmir A. Nunberg

[57] ABSTRACT

Free standing, combined product display and storage device particularly suitable for store merchandising of shoes and characterised by including the combination of two end panels having between them a plurality of storage shelves positioned one above the other with storage spaces between them, the end panels extend a distance beyond the front edges of the shelves and carry between them a series of horizontally disposed trough-like formations positioned side-by-side with one above the other and hiding the storage shelves from customer view, each trough-like formation having an upper and a lower outwardly extending sides with each lower side being comprised of a plurality of contiguous product display platforms in a row and resting on the outer edge of the upper side of the next lower trough-like formation, each product display platform being fulcrumed to pivot upwardly to provide access to the storage space on an associated one of the storage shelves. Each of the trough-like formations is comprised of a thin flexible material carried by three support rods held at their respective ends in holes in the end panels. One of the support rods provides the fulcrum about which the row of display platforms pivot. The display platforms have stiffener members fixed to them to provide rigidity for carrying the displayed product. An alternate embodiment includes the same kind of series of trough-like formations at the back side of the storage shelves to thereby increase the number of product display platforms, thereby increasing the merchandising efficiency of the unit. Also the end panels can be used as divider panels for a series of similar end-to-end combined product display and storage units.

9 Claims, 4 Drawing Figures

COMBINED PRODUCT DISPLAY AND STORAGE UNIT

BACKGROUND OF THE INVENTION

This invention relates to combined product display and storage equipment and more particularly to a combined product display and storage unit particularly suitable for merchandising of shoes and the like and which makes possible increased efficiency in utilization of floor space and sales personnel for product merchandising and is comprised of two end panels having between them a plurality of shelves positioned one above the other with storage spaces between them the end panels extending a distance beyond the front edges of the shelves, a series of horizontally disposed trough-like formations positioned side-by-side with one above the other at the front edges of the shelves and between the panel extensions to hide the shelves from customer view, each trough-like formation having an upper and a lower outwardly extending sides, the lower side of each trough-like formation being comprised of a plurality of contiguous product display platforms in a row at the upper side of the next lower trough-like formation, each product display platform being fulcrumed to pivot upwardly to provide access to the storage space on an associated one of the shelves.

The practice in merchandising products such as shoes is generally such that it is difficult for a customer or prospective customer to examine a shoe offered for sale without the attendance of a salesperson. This is because shoes are ordinarily packaged in boxes and the boxes arranged upon shelves, some of which are along the walls of the merchandising sales room and a large portion of which are warehoused in backrooms accessible to only the sales personnel. While the customer or prospective customer may often observe some relatively few shoes which are set out to show a few samples carried in stock, it is an infrequent coincidence if such displayed samples are in the proper size and style desired by the customer. Seeing the shoe in the customer's size and style is particularly desirable for women's shoes because of the many styles and the fact that styles may vary in attractiveness depending upon the size of the particular shoe in such style. For example, a shoe which may be attractive to a customer in a small size 5 may be quite unattractive in a size 10. Hence a prospective customer being aware of this possibility, necessarily desires in a shopping tour to see the various styles of shoes in her own particular size before making a purchase determination. However, in view of the high cost of maintaining sufficient sales personnel to service prospective customers, many sales are lost for either lack of time or impatience of a prospective customer to wait for service of a sales person.

Also, much of the merchandising value of store space is lost in that, as pointed out above, most of the shoes are hidden from view in boxes carried on storage shelves in the sales room as well as being warehoused in the back rooms of the store accessible only to employees. Some efforts have been made toward increasing merchandising display and more efficient storage, but such equipment is generally too expensive in construction, lacks sufficient versatility or creates other undesirable problems. For example U.S. Pat. No. 1,603,590 proposes a structure for inserting in conventional wall shelves a display panel for some of the stored shoes. The device carries a hinged board at the front of the shelf extending the width of a shelf section with mechanism occupying some of the storage space and requires lifting of the entire hinged board for access to the storage space behind the board, even though the board is long enough to be carrying a long line of shoes on display.

In a more recent U.S. Pat. No. 3,552,576, a greater display capacity is achieved with a boxlike telescoping structure wherein shoes are displayed on two opposed walls between which is a telescoping boxlike storage structure which may be laterally moved with respect to the display walls for access to the mate of a displayed shoe. While this structure has greater display appeal over that of the shelf insert device mentioned above, it is nevertheless cumbersome in its operation in that it is relatively complex in construction and requires lateral clearance space for telescoping movement of the boxlike storage compartment and thereby loses valuable merchandising space within a store.

Accordingly it is an object of the present invention to provide a combined product display and storage device which permits the conversion of warehousing and other storage space into highly productive merchandising space.

Another object is the provision of a combined product display and storage device which is particularly applicable for merchandising products which are sold in a variety of sizes and styles such as shoes, overshoes, and the like.

And a further object is the provision of a combined product display and storage device with permits efficient display of one of a pair of all sizes of shoes in all styles carried by a store for customer view without the need for prior assistance of sales personnel.

And a still further object is the provision of a combined product display and storage device which retains hidden the mate of each displayed shoe in readily accessible position for sales personnel without the need for leaving the site of the displayed shoe and which provides a deterrent to stealing by others.

And another object is the provision of a combined product display and storage device which is applicable to display of products in front of wall shelves as well as display on both sides of the shelves.

Further objects include the provision of of a combined product display and storage device which lends itself to free standing construction moveable to any desired floor position, may be manually assembled and dissassembled without tools of any kind, and lends itself to rapid and relatively inexpensive component changes as well as positioning in adjoining consecutive units to form rows of any desired length.

SUMMARY OF THE INVENTION

In a preferred embodiment of the invention, a combined merchandising product display and storage device includes the combination of two end panels having between them a plurality of spaced apart storage shelves positioned one above the other with the two end panels extending a distance beyond the front edges of the shelves and carrying a series of horizontally disposed trough-like formations positioned side-by-side with one above the other in front of the shelves in manner to hide from view the storage shelves and any stored products thereon, each of the trough-like formations having an upper and lower sides extending outwardly from a base in front of the storage shelves, the lower side of each of the trough-like formations being composed of a plurality of contiguous product display platforms in a single row located at the upper side of the next lower trough-like formation with each merchandising product display platform being fulcrumed to pivot at the base upwardly to provide access to the storage space on an associated one of the storage shelves.

By making the trough-like formations of a flexible material such as cloth, leather or thin plastic material carried on rods having rod ends fixed to the panels, and providing stiffeners at each of the product display platforms, a relatively inexpensive shielding structure for hiding the shelves and storage area and an attractive arrangement for merchandising display of products is thereby achieved as well as a structure which lends itself to relatively easy and inexpensive replacement for maintaining a fresh appearance as a merchandising asset is thereby achieved.

By providing three rods for each trough-like formation in which one end of the flexible material is fixed to one of the rods positioned to form the outer edge of the upper side of the trough-like formation as well as support for the row of contiguous product display platforms which form the lower side of the next higher trough-like formation, the second rod with the flexible material providing the inner edge of the upper side of the trough-like formation, and the third of the rods providing, with the flexible material, the inner edge of the lower side as well as the fulcrum for pivoting of each of the plurality of the contiguous product display platforms in the row forming the lower side of the trough-like formation, a structurally economical and easily operable merchandising product display and storage space hiding arrangement is thereby achieved.

By making the rods of a length such that the rod ends are held in shallow holes in the end panels and are of a material such as wood, metal or resilient plastic of a sufficient flexibility permitting them to be removed from the associated shallow holes by flexing the respective rod to shorten its effective length, rapid manual assembly and dissassembly of the trough-like formations without special tools of any kind is thereby achieved.

By fixing the platform stiffener to the flexible material by cementing or stapling and including a downwardly projecting lip overlapping the outer edge of the upper side of the next lower trough-like formation, each platform thereby achieves a positive stabilizing support from the rods carrying the trough-like formations.

By rigidly fixing one leg of an L shaped member to each end of each of the shelves, with the other leg depending downwardly into a slot formed by a receiving bracket rigidly fixed to the associated end panel to thereby rigidly fix the ends of the shelves to the end panels with capacity for rapid manual assembly and dissassembly with respect to the end panels, a combined merchandising product display and storage device may be readily dissassembled for compact storage and transportation and conversely readily assembled as a free standing structure moveable to any desired location in a store for merchandising product display and product storage.

By extending the end panels a distance beyond the back edges of the shelves and providing another series of the horizontally disposed trough-like formations positioned side-by-side one above the other at the back edges of the shelves in similar manner to the trough-like formations in front of the front edges of the shelves, additional efficient merchandising product display capacity from the same device is thereby achieved.

By proportioning the trough-like formations in manner such that the rows of contiguous product display platforms at the front edges of the shelves provide access to the storage areas on alternate ones of the shelves and the rows of contiguous product display platforms at the back edges of the shelves provide access to the storage areas on the shelves located between the above mentioned alternate shelves, makes possible the display of different products on the respective sides of the shelves without possible confusion between the products displayed and those in storage on respective shelves accessible from the associated display platforms.

DESCRIPTION OF THE DRAWINGS

The features of the invention which are believed to be novel are set forth with particularity in the appended claims. The invention and the features, objects and advantages thereof will be better understood from the following description in conjunction with the accompanying drawings in which like reference numbers identify like components and in which:

DESCRIPTION OF THE ILLUSTRATIVE EMBODIMENT

Figure 1:
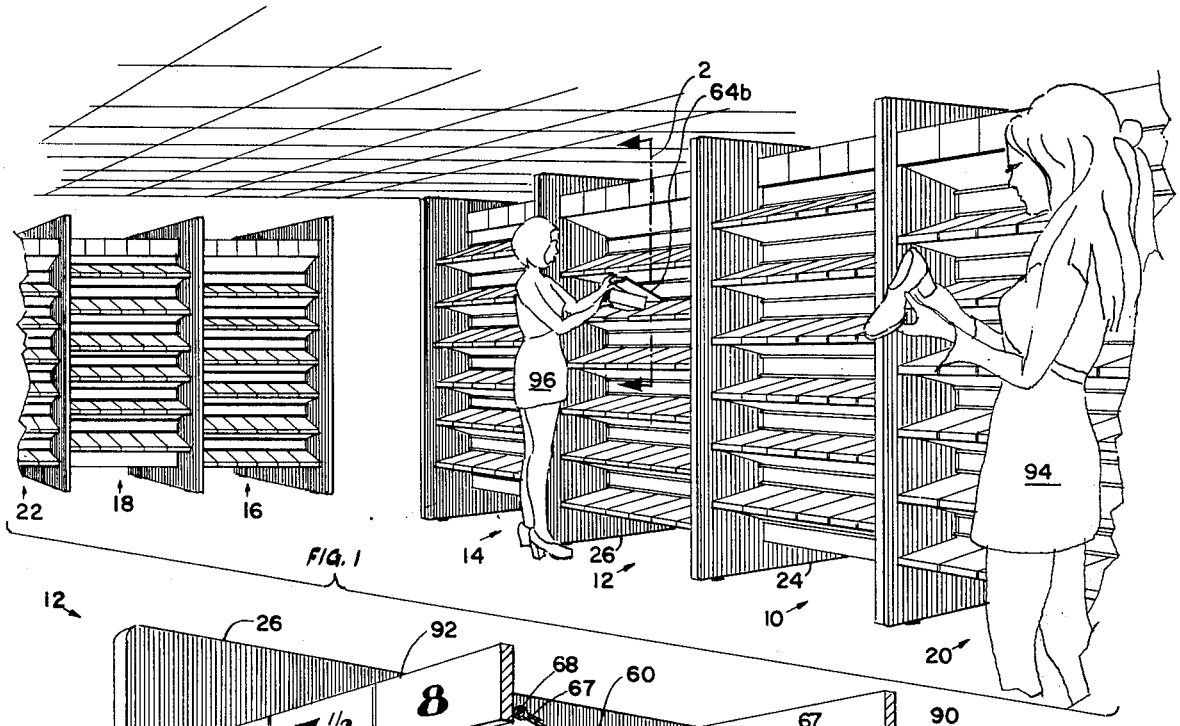
FIG. 1 is a perspective view of several combined merchandising product display and storage units in an exemplary arrangement in a store for merchandising shoes to show both the construction of preferred embodiments of the invention as well as suitable arrangement of the invention in store layout.

Referring to FIG. 1 in more detail, an exemplary shoe store arrangement carrying five complete combined merchandising product display and storage units in accordance with the present invention are designated by the numerals 10, 12, 14, 16 and 18 respectively, and segmentary portions of two others are designated by the numerals 20 and 22. As visible from an inspection of FIG. 1, the respective combined merchandising product display and storage units are similar and therefor the following description will be confined primarily to the combined merchandising product display and storage unit 12 with the understanding that it applies to the other units also except where a few minor differences that do exist in structural arrangement among the respective units are specifically mentioned and described.

Figure 2:
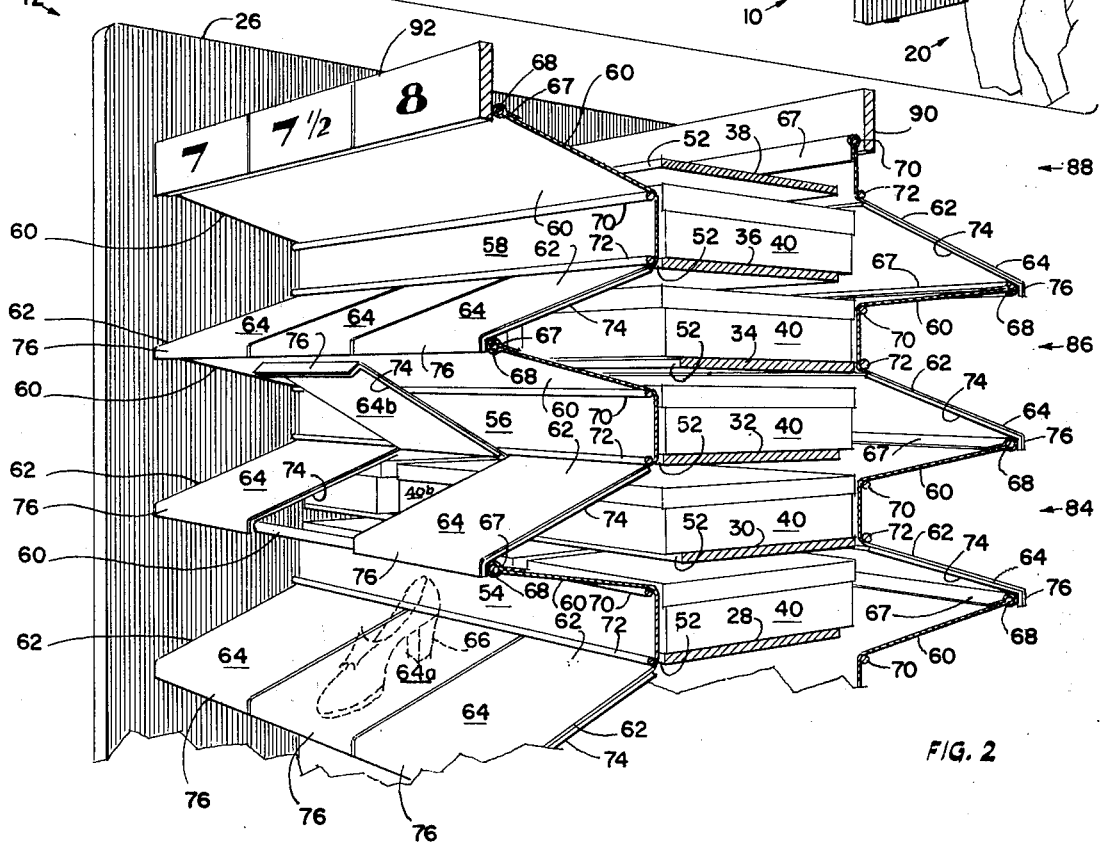
FIG. 2 is a perspective view to enlarged scale of a cutaway section of one of the merchandising product display and storage units shown in FIG. 1 and taken on line 2 of FIG. 1 in the direction of the arrows to more clearly show construction.

The combined merchandising product display and storage unit 12 has two end panels 24 and 26 which have between them thirteen shelves of which twelve are storage shelves such as 28, 30, 32 and 36, and one is a cover shelf (FIG. 2) positioned one above the other storage spaces between each of the shelves for carrying storage boxes 40. Alternate storage shelves such as 30 and 34 are for access from the left hand side of the structure shown in FIG. 2, and alternate storage shelves such as 28, 32 and 36 are for access from the right hand side of the FIG. 2 illustration for reasons to be hereinafter further explained.

Figure 4:
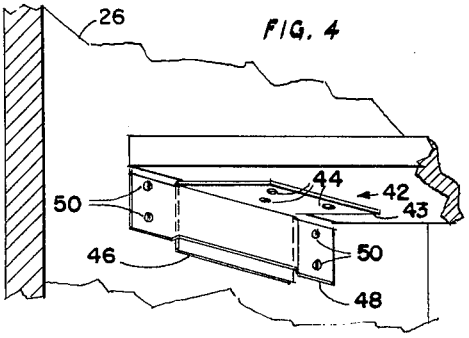
FIG. 4 is a perspective view of a segment of a representative one of the end panels shown in FIGS. 1 and 2 together with an end segment of a representative one of the storage shelves to show structure for fastening the storage shelves to the end panels for rapid manual assembly and dissassembly.

Each of the shelves has fixed to the underside respective ends thereof an L shaped fastening member such as shown in FIG. 4 with respect to one end of the shelf 36 where one leg 43 of the L shaped bracket 42 is fixed to the underside end of the shelf 36 by screws 44 and the other leg 46 is depending downwardly and held against the end panel 26 in a slot formed by a bracket 48 fixed to the inside surface of the end panel 26 by screws 50. Thus all of the shelves have a fastening arrangement at each end similar to the FIG. 4 illustration and may thereby be manually assembled and dissassembled with respect to the respective end panel, such as end panel 26, by lifting the respective shelf, such as shelf 36, so that the downwardly depending leg 46 of the L shaped bracket 42 is clear of the slot formed by the bracket 48 at the end panel 26.

The end panels 24 and 26 extend beyond the front edges 52 of the shelves, such as 28 through 38, and carry between them a series of horizontally disposed trough-like formations, such as the trough-like formations 54, 56 and 58, positioned side-by-side with one above the other at the front edges 52 of the shelves. Each of the trough-like formations, such as 54, 56 and 58, have outwardly extending upper and lower sides 60 and 62 respectively. The lower side 62 of each of the trough-like formations, such as 54, 56 and 58, is comprised of a plurality of contiguous product display platforms 64 with each lower side 62 forming a row of such plurality of contiguous product display platforms 64 positioned at the upper side 60 of the next lower trough-like formation. Each product display platform 64 is proportioned for displaying a product similar to that carried in the storage boxes 40, which in this instance are ladies shoes, one of which is shown by broken lines 66 on the display platform 64*a*.

The trough-like formations, such as 54, 56 and 58 are preferably made of a flexible material such as cloth, leather, or flexible plastic membrane such as vinyl, one edge of which is fixed by a casing 67 to an upper support rod 68 to form the upper edge of the upper side 60 of each of the trough-like formations and is carried at the base of each trough-like formation by an upper and lower base rods 70 and 72 respectively. A stiffener plate 74 of such material as plywood, fiberboard, or stiff plastic is fixed by cementing, stapling or other suitable means to the underside of the flexible material forming the display platforms 64, each of which includes a downwardly projecting overhang or lip 76 overlapping the upper support rod 68 which forms the upper edge of the upper side 60 of the next lower trough-like formation. The lower base rod 72 in each of the trough-like formations froms a fulcrum about which the respective merchandising display platform 64 pivots so that the associated display platforms may be pivoted upwardly as shown by display platform 64*b* (FIGS. 1 and 2) to provide access to the storage space on the associated storage shelf 30 which for the display platform 64*b* provides access to the storage box 40*b*. In the present instance box 40*b* will carry the mate to the shoe displayed on the platform 64*b* in manner of the shoe 66 on display platform 64*a*.

The front edges 52 of alternate shelves such as 30 and 34 are not as far forward as the front edges 52 of alternate shelves 28, 32 and 36. The front edges 52 of the alternate shelves 30 and 34 leave a finger gripping clearance for the box 40*b* and other boxes 40 on the alternate storage shelves 30 and 34. The purpose for this is to make it easy to manually grasp and withdraw the boxes, such as box 40*b*, when the associated display platform, such as 64*b*, is pivoted upwardly to provide access to the box 40*b*.

The other alternate storage shelves, such as 28, 32 and 36 are accessible through display platforms 64 of trough-like formations, such as 84, 86 and 88 at the back edges of the shelves and between extensions of the end panels 24 and 26 beyond the back edges of the shelves. The through-like formations, such 84, 86 and 88, at the back edges of the shelves are the same in construction as the trough-like formations 54, 56 and 58 except in that they are vertically displaced by a distance equal to the spacing between the respective shelves such as shelves 32 and 34 to provide access to the alternate storage shelves 28, 32 and 36 which are not accessible through the trough-like formations 54, 56 and 58. Because of such displacement, the top-most formation 88 has no upper side such as upper side 60 and in place thereof is a trim board 90 at the upper base support rod 70 to which the flexible material of the formation 88 is fixed by a casing 67.

The trim board 90 is similar to and at the same height as a trim board 92 at the top edge 68 of the trough-like formation 58 to provide a balanced and finished appearance to the overall structure. Both trim boards 90 and 92 are fastened at their ends to the respective end panels 24 and 26 by a basket arrangement similar to that shown in FIG. 4 for ease in manual assembly and dissassembly in manner similar to that described with respect to FIG. 4. Each of the trim boards 90 and 92 may also be sectioned on their faces to carry indicia to identify displayed products, in this instance identifying sizes and styles to be found on the product display platforms 64 directly beneath the associated indicia.

Figure 3:
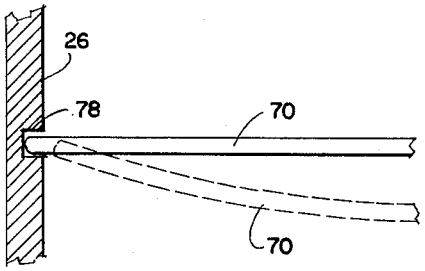
FIG. 3 is a cross sectional view to further enlarged scale of a segment of the end panel at a representative one of the support rods of FIGS. 1 and 2 for showing the end of the support rod being carried in a shallow blind hole in the end panel, and in broken lines the support rod flexed for removal of the support rod from the hole.

Each of the support rods 68, 70 and 72 in the respective trough-like formations are similar and parallel to each other and their respective ends are carried in shallow blind holes such as the hole 78 in panel 26 carrying the end of the support rod 70 shown in FIG. 3. The support rods 68, 70 and 72 are of a material such as aluminum, steel or wood which has sufficient resilience for being flexed as shown by the broken lines in FIG. 3 to thereby reduce the effective length by an amount such that the support rod may be removed from the hole 78. Thus the support rods 68, 70 and 72 may be manually assembled to and dissassembled from the end panels 24 and 26 without special tools and provide an inexpensive arrangement for replacing the trough-like formations which become shop-worn or to change the color scheme and so maintaining a continuously fresh and pleasing merchandising product display arrangement.

The invention lends itself to further economy by using both faces of the panels, such as 24 and 26, for supporting adjacent merchandising product display and storage units such as 10 and 14 respectively in FIG. 1.

In such event, the end panels 24 and 26 become divider panels for successive bays of product display and storage units, a structure which makes maximum use of floor space for merchandising products. To enhance the appearance of the successive bays, the trough-like formations in the successive bays are alternately displaced vertically with respect to each other. For example in bays 20, 12, 16 and 22, the trough-like formations are at levels like those of 54, 56 and 58. Whereas in alternate bays 10, 14 and 18, the trough-like formations are at levels like those of 84, 86 and 88. The divider panels in addition to providing structural support, also provide vertical visual relief to the horizontally aligned display platforms 64, as well as a pleasing decorative contribution to the overall appearance which is further aided by suitable coloration as in the drawings which are lined to indicate the color code of red.

In operation in a shoe store, one of each of the various styles in each size carried by the store are set out on the individual display platforms 64 in manner similar to that of shoe 66 on display platform 64*a*. The mate of each of the displayed shoes is stored in the shoe box 40 on a storage shelf directly behind the associated display platform, such as box 40*b* for the display platform 64*b*. Prospective customers may closely examine the individual shoes on display in manner similar to that of the prospective customer 94 in FIG. 1, but are deterred from stealing the viewed shoe because the mate is in storage. When the customer decides to purchase a selected shoe, an employee is contacted who supplies the other shoe from the conveniently located storage shelf behind the display platform in manner similar to that of the employee 96, thereby minimizing employee time per customer sale.

This invention is not limited to the particular details of construction and operation described as equivalents will suggest themselves to those skilled in the art.

What is claimed is:

1. In a combined merchandising product display and storage device, the combination of two end panels having between them a plurality of shelves positioned one above the other with storage spaces therebetween and having front edges, the end panels extending a distance beyond the front edges of the shelves, a series of horizontally disposed trough-like formations positioned side-by-side with one above the other at said front edges of the shelves and between said panel extensions in manner to shield associated storage spaces from view, each trough-like formation having an upper and a lower outwardly extending sides, the lower side of each of said trough-like formations being comprised of a plurality of contiguous product display platforms in a row at the upper side of the next trough-like formation, each product display platform being fulcrumed to pivot upwardly to provide access to the storage space on an associated one of said shelves.

2. The combination as in claim 1 wherein said trough-like formations are comprised of a flexible material carried on rods having ends fixed to said panels and each of said product display platforms has a stiffener providing support to said displayed product.

3. In a combined merchandising product display and storage device, the combination of two end panels having between them a plurality of shelves positioned one above the other with storage spaces therebetween and having front edges, the end panels extending a distance beyond the front edges of the shelves, a series of horizontally disposed trough-like formations positioned side-by-side with one above the other at said front edges of the shelves and between said panel extensions, each trough-like formation having an upper and a lower outwardly extending sides, the lower side of each of said trough-like formations being comprised of a plurality of contiguous product display platforms in a row at the upper side of the next lower trough-like formation, each product display platform being fulcrumed to pivot upwardly to provide access to the storage space on an associated one of said shelves, the trough-like formations being comprised of flexible material carried on rods having ends fixed to said panels and each of said product display platforms having a stiffener providing support to said display product, the upper and lower sides of said trough-like formations each having outer and inner edges and there being three of said support rods in each of said trough-like formations for carrying said flexible material, one of said rods having fixed thereto said flexible material to form the outer edge of said upper side of the trough-like formation and providing support for the row of contiguous product display platforms which form the lower side of the next higher trough-like formation, a second one of said rods providing with said flexible material the inner edge of said upper side, and the third of said rods providing with said flexible material the inner edge of said lower side and the fulcrum for pivoting of each of the plurality of contiguous product display platforms of said lower side.

4. The combination as in claim 3 wherein the stiffener of each of said plurality of product display platforms is fixed to the flexible material and includes a downwardly projecting lip overlapping the outer edge of the upper side of the next lower trough-like formation.

5. The combination as in claim 3 wherein the ends of each of said rods is held in an associated shallow hole in said end panels and said rods have a flexibility such that they may each be removed from said associated shallow hole by flexing the respective rod to shorten its effective length.

6. The combination as in claim 5 wherein said shelves are ridigly fixed to said panels for thereby making said merchandising product display and storage device a free standing unitary structure which is moveable to any desired floor position in a store.

7. The combination as in claim 5 wherein each of said shelves has two ends with each shelf end having ridigly fixed thereto one leg of an L shaped member with the other leg depending downwardly into a slot formed by a receiving bracket rigidly fixed to the associated end panel to thereby rigidly fix the ends of said shelves to said end panels with capacity for rapid manual assembly and dissassembly with respect to said end panels whereby said merchandising product display and storage device may be readily dissassembled for compact storage and transportation and readily assembled as a free standing device for merchandising product display and storage.

8. The combination as in claim 6 wherein said plurality of shelves have back edges in opposed relation to said front edges, said end panels extend a distance beyond the back edges of said shelves, and another series of horizontally disposed trough-like formations positioned side-by-side one above the other at said back edges of said shelves, said last mentioned trough-like formations being similar to said first mentioned trough-like formations.

9. The combination as in claim 8 wherein the rows of contiguous product display platforms at the front edges of said shelves provide access to the storage areas on alternate ones of said shelves and the rows of contiguous product display platforms at the back edges of said shelves provide access to the storage areas on the shelves located between said alternate shelves.

* * * * *